US008186102B1

(12) United States Patent
Lawrence

(10) Patent No.: US 8,186,102 B1
(45) **Date of Patent: *May 29, 2012**

(54) TILT LATCH

(76) Inventor: Barry G. Lawrence, Thomasville, NC (US)

( * ) Notice: Subject to any disclaimer, the term of this patent is extended or adjusted under 35 U.S.C. 154(b) by 277 days.

This patent is subject to a terminal disclaimer.

(21) Appl. No.: 12/647,008

(22) Filed: Dec. 24, 2009

Related U.S. Application Data

(63) Continuation of application No. 11/599,129, filed on Nov. 14, 2006, now Pat. No. 7,658,035, which is a continuation-in-part of application No. 11/274,540, filed on Nov. 15, 2005, now Pat. No. 7,520,541.

(51) Int. Cl.
*E05D 15/22* (2006.01)

(52) U.S. Cl. ..... 49/185

(58) Field of Classification Search ..... 49/183, 49/184, 185; 292/175, 337, DIG. 31
See application file for complete search history.

(56) References Cited

U.S. PATENT DOCUMENTS 4,475,311 A * 10/1984 Gibson ..... 49/176
4,669,765 A * 6/1987 Ullman ..... 292/153
4,837,975 A * 6/1989 Simpson ..... 49/175
4,901,475 A * 2/1990 Simpson ..... 49/175
5,139,291 A * 8/1992 Schultz ..... 292/42
5,618,067 A * 4/1997 Carlson et al. ..... 292/175
5,669,639 A * 9/1997 Lawrence ..... 292/175
5,671,958 A * 9/1997 Szapucki et al. ..... 292/175
6,021,603 A * 2/2000 Prete et al. ..... 49/183
6,155,615 A * 12/2000 Schultz ..... 292/163
6,485,070 B1 * 11/2002 Schultz ..... 292/175
RE37,916 E * 12/2002 Szapucki et al. ..... 292/175
6,722,712 B2 * 4/2004 Schultz ..... 292/175
6,832,792 B2 * 12/2004 Polowinczak et al. ..... 292/36
6,874,826 B1 * 4/2005 Polowinczak et al. ..... 292/175
6,948,278 B1 * 9/2005 Schultz ..... 49/185
7,171,784 B2 * 2/2007 Eenigenburg ..... 49/181
7,222,458 B2 * 5/2007 Polowinczak et al. ..... 49/181
7,431,355 B2 * 10/2008 Eenigenburg et al. ..... 292/175
7,658,035 B1 * 2/2010 Lawrence ..... 49/185
7,856,757 B2 * 12/2010 Ozawa ..... 49/176

* cited by examiner

*Primary Examiner* — Jerry Redman

(57) ABSTRACT

A tilt latch for pivotable window sashes is preferably integrally molded from a durable polymeric material but can also be made from other materials, for example metal and metal alloys. The latch includes an angled projection for engaging a recess in the window frame and includes a central body having a cavity for containing a coil spring. Upper and lower covers overhang the sides of the body to form channels for engaging the edge of the sash groove. An alternate embodiment of the tilt latch includes a body and a plunger containing a resilient member. A projection on the body engages a window recess. A resilient member is contained within the cylindrical plunger housing to prevent unwanted distortion and slippage.

12 Claims, 11 Drawing Sheets

TILT LATCH

This is a continuation of and claims benefits under patent application Ser. No. 11/599,129 filed 14 Nov. 2006, now U.S. Pat. No. 7,658,035, which is a continuation-in-part of and claims benefits under pending patent application Ser. No. 11/274,540 filed 15 Nov. 2005, now U.S. Pat. No. 7,520,541.

FIELD OF THE INVENTION

The invention herein pertains to pivotal window sashes and particularly pertains to latches which maintain the pivotal sashes in a closed posture.

DESCRIPTION OF THE PRIOR ART AND OBJECTIVES OF THE INVENTION

Windows having pivotable or "tilt" sashes have become widely accepted in recent years due to improved mass production techniques, hardware and other innovations. Tilt windows can be easily cleaned from inside the house or building and are often left open during light rainfall to provide fresh air to the occupants. Conventional pivotal sashes utilize a pair of latches at opposing ends of the top frame member which are manually operated to open the sash. Standard sash latches as shown in U.S. Pat. Nos. 5,139,291 and 5,669,639 are generally spring operated and engage catches or recesses along the sides of the window frame when closed. Some conventional latches create openings along the latch top when the latch is operated, exposing the interior features such as springs, slides and the like. Dust, debris and moisture can penetrate the opening to jam or foul the latch mechanism. Also, some conventional sash latches require a mounting slot to be cut to exacting standards in the top of the sash for the latch to properly operate. Other standard latches employ an internal spring which requires detailed, labor intensive latch assembly. Should these springs become weak or broken during use they are difficult to repair and maintain, rendering the latch useless.

Thus in view of the problems and disadvantages of conventional window sash tilt latches, the present invention was conceived and one of its objectives is to provide a simple tilt latch in which little assembly is required.

It is another objective of the present invention to provide a tilt latch which can easily be fitted with a spring by unskilled persons.

It is another objective of the present invention to provide a tilt latch which operates in a variety of sash slots formed with large tolerances.

It is still another objective of the present invention to provide a tilt latch that can be easily inserted or removed from the window sash without special tools or equipment.

It is yet another objective of the present invention to provide a tilt latch in which the spring can be quickly removed and replaced after the latch is mounted in a window sash.

It is a further objective of the present invention to provide a tilt latch that is relatively inexpensive to manufacture and purchase.

It is another objective of the present invention to provide a tilt latch that operates under high wind conditions.

It is also an objective of the present invention to provide a tilt latch that is difficult for small children to operate.

It is yet a further objective of the present invention to provide a tilt latch that increases reliability by preventing spring distortion and slippage by the use of a plunger.

Various other objectives and advantages of the present invention will become apparent to those skilled in the art as a more detailed description is set forth below.

SUMMARY OF THE INVENTION

The aforesaid and other objectives are realized by providing a tilt latch preferably molded as one part from a standard, rigid, durable glass reinforced nylon and includes a cavity for maintaining a spring. By forming the latch in one piece a stronger, more durable latch is achieved for performing at higher sash pressure ratings. The latch includes a body having a front, angled projection. Upper and lower covers sandwich the body, slightly overhanging the body sides and are substantially coplanar with the outer surfaces of the angled projection. The projection engages a recess in the window frame to secure the sash when it is closed. Mirror image left and right tilt latches are formed for the respective sides of the window sash to mount within grooves on opposing sides of the top of the sash. Ramps on each side of the lower cover assist in the insertion of the latch into the sash groove.

The upper and lower covers extend beyond or overhang the sides of the body to provide channels for engaging the edges of the groove formed in the top of the window sash. Ramps on each side of the latch slightly, temporarily distort or spread the groove during latch insertion. The groove is positioned in the top of a sash tubular frame member as conventional. The upper cover of the tilt latch includes a top finger tab and extends rearwardly beyond the body parallel to the lower cover. Opposing channels are formed in the rear of the upper and lower covers to guide and maintain a resilient member such as a coil spring in a stable position proximate the spring cavity in the body. A spring can thus be inserted through the channels into the cavity of the body before mounting the latch into the sash groove. Shoulders formed by the upper and lower covers proximate the projection stop and prevent the latch from escaping the sash groove once the latch is installed as the spring normally urges the latch outwardly. The lower cover shoulders adjacent the ramps abut the inside edges of the sash. The upper cover shoulders abut gates positioned on modified sashes to provide additional strength and latch integrity. The projection extends beyond the side of the sash when the sash is open. The finger tab can be used to retract the latch, such as when opening or closing the sash.

As the sash is rotated towards the window frame the extended latch projections strike the jamb edges and due to the angled configuration of the projections, the jamb edges urge the latches (retract the latches) deeper into the sash grooves. Once the sash is completely closed the latch projections then extend outwardly into the window frame or jamb recesses to secure the window sash in its closed posture with the projections fully seated in the recesses as usual.

In an alternate embodiment, a tilt latch is provided which is comprised of a body and a plunger assembly. The body fits into a groove formed in the window sash, and is attached to the groove rim. The body is engaged with the plunger assembly and is comprised of a distal end projection that extends into the window frame recess for latching, a finger tab for manipulating the distal end projection and guides for engaging the plunger assembly. The plunger assembly includes a housing for containing a resilient member and protrusions for engaging the guides of the body. The tilt latch also includes a lock to secure the distal end projection in a desired position to prevent unwanted opening of the window sash.

To operate the alternate tilt latch, the lock is manually rotated to an open position and the finger tab is slid. This results in compression of the resilient member and disengagement of the distal end projection from the window frame recess thereby allowing the tiltable sash to pivot. When the finger tab is released, the resilient member returns to its extended state and the distal end projection moves outwardly beyond the sash to engage the window frame recess to latch the sash in place. The latch is then locked into position by manually rotating the lock to prevent distal end projection movement.

BRIEF DESCRIPTION OF THE DRAWINGS

The drawings referenced herein vary in size and are not drawn to scale.

DETAILED DESCRIPTION OF THE PREFERRED EMBODIMENT AND OPERATION OF THE INVENTION

Figure 1:
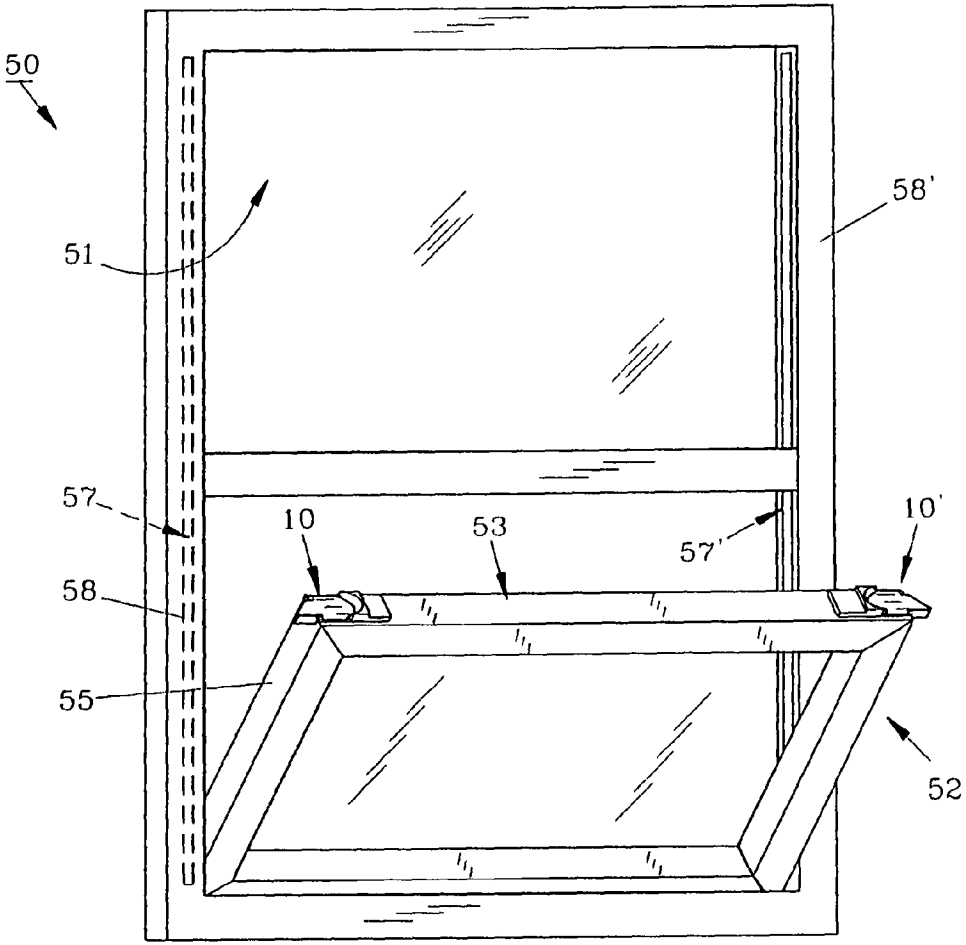
FIG. 1 shows a typical pivotable window with tilt latches of the invention positioned along the top of the pivotal sash.

For a better understanding of the invention and its operation, turning now to the drawings, FIG. 1 shows typical tilt window 50 as used in exterior walls of houses and other buildings. Window 50 includes side frame members 58, 58' with respectively tilt latch frame recesses 57, 57' therein, fixed upper window sash 51 and lower pivotable or tiltable window sash 52. Conventional windows are often manufactured with two or more tiltable sashes and are well known in the trade.

As further seen in FIG. 1, pivotable sash 52 comprises upper frame member 53 having sash grooves 54 (FIG. 5), 54' (54' not shown) and side frame member 55. A pair of preferred tilt latches 10, 10' are shown mounted thereon, each of which slide in respectively grooves 54, 54' also seen enlarged in FIGS. 5 and 6. As would be understood, tilt latches 10, 10' are mirror images, for mounting in respectively grooves 54, 54' formed in the left and right sides of sash 52 as seen in FIG. 1.

Figure 7:
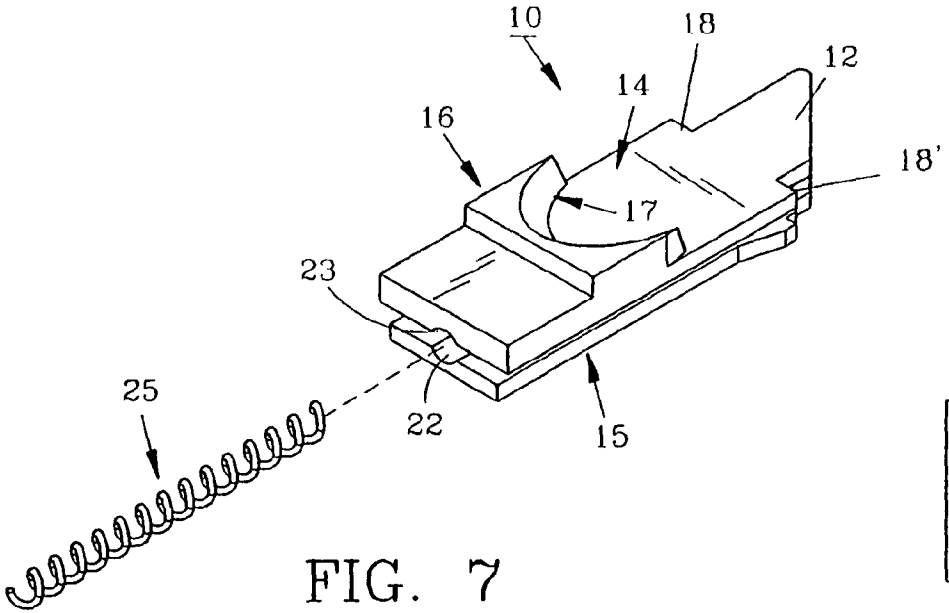
FIG. 7 depicts a rear perspective view of the preferred tilt latch of the invention removed from the sash and with the spring exploded therefrom.
Figure 10:
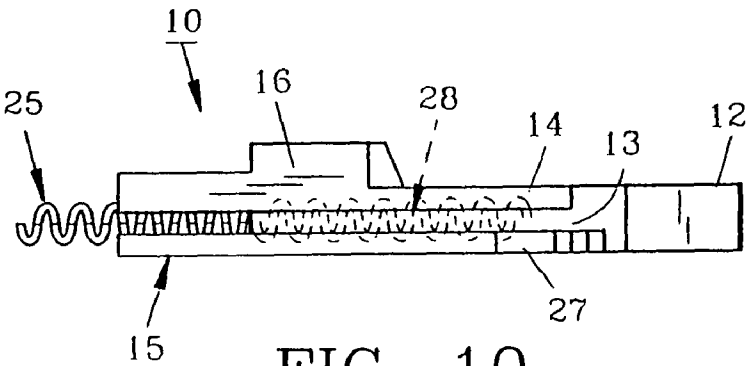
FIG. 10 shows a right side elevational view of the tilt latch with the spring mounted therein.

As seen in FIG. 10, tilt latch 10 comprises body 13 having cavity 28 (also seen in FIG. 4) therein, upper cover 14 having shoulders 18, 18' (FIG. 7), lower cover 15 with shoulders 19, 19' (FIG. 12) and projection 12. As seen in FIG. 7, upper cover 14 and lower cover 15 include respectively upper channel 23 and lower channel 22 for receiving and maintaining coil spring 25 therein. Tilt latch 10 also includes top finger tab 16 with arcuate face 17 for manipulation of latch 10 when opening or closing sash 52.

Figure 2:
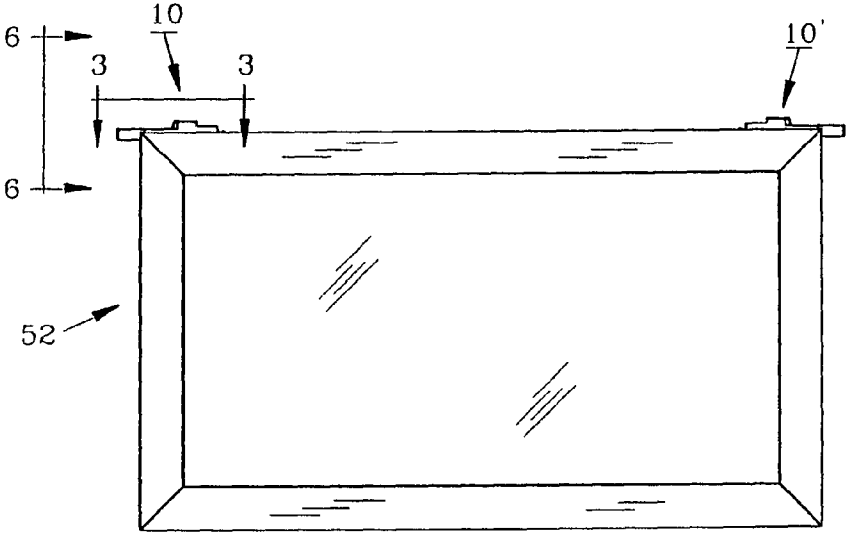
FIG. 2 demonstrates the sash as seen in FIG. 1 in an enlarged vertical position as removed from the window.
Figure 3:
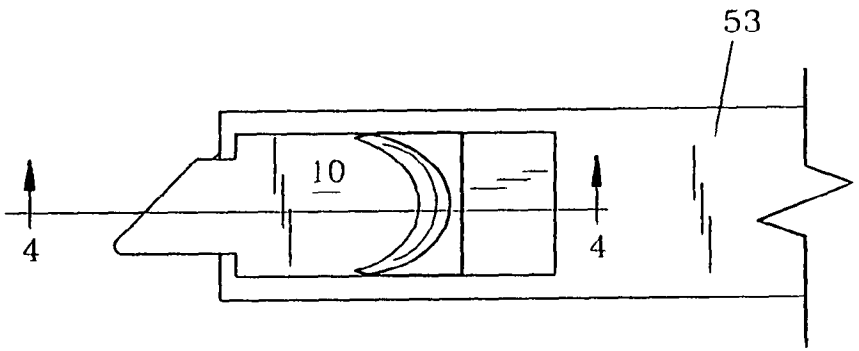
FIG. 3 illustrates a top fragmented view of the sash as along lines 3-3 of FIG. 2.

Sash 52 is shown in a front elevational view in FIG. 2 as removed from window 50 with tilt latches 10, 10' mounted thereon. FIG. 3 shows a top view of tilt latch 10 mounted in frame member 53 while FIG. 4 provides a cross-sectional view showing cavity 28 with spring 25 therein abutting rear edge 62 of groove 54 with projection 12 extending therefrom.

Figure 6A:
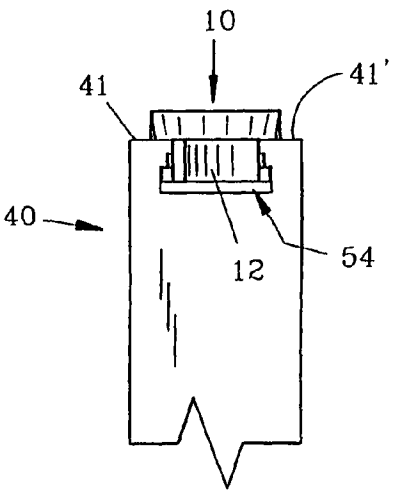
FIG. 6A shows a partial front view of the alternate sash seen in FIG. 5A.
Figure 5A:
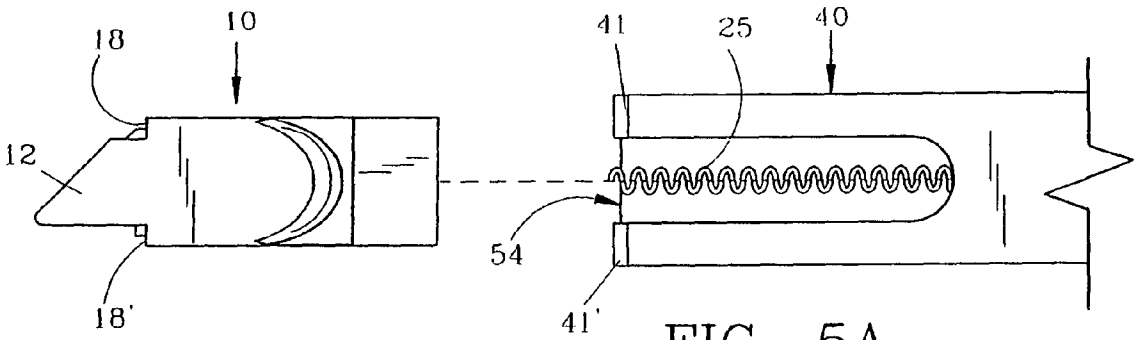
FIG. 5A pictures an alternate partial sash top view with latch gates.

Standard sash frame 40 seen only in partial view in FIGS. 5A and 6A has been modified by the addition of stops or gates 41, 41' along the front top of groove 54. Gates 41, 41' engage shoulders 18, 18' of upper cover 14 of tilt latch 10 to prevent removal from groove 54 during operation. Gates 41, 41' can be formed during sash manufacturing or can be added to a standard sash for extra durability and maintenance of latch 10 therein.

Figure 6:
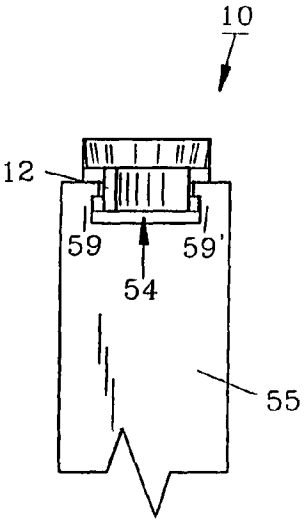
FIG. 6 demonstrates a front view of a section of the sash as along lines 6-6 of FIG. 2.
Figure 5:
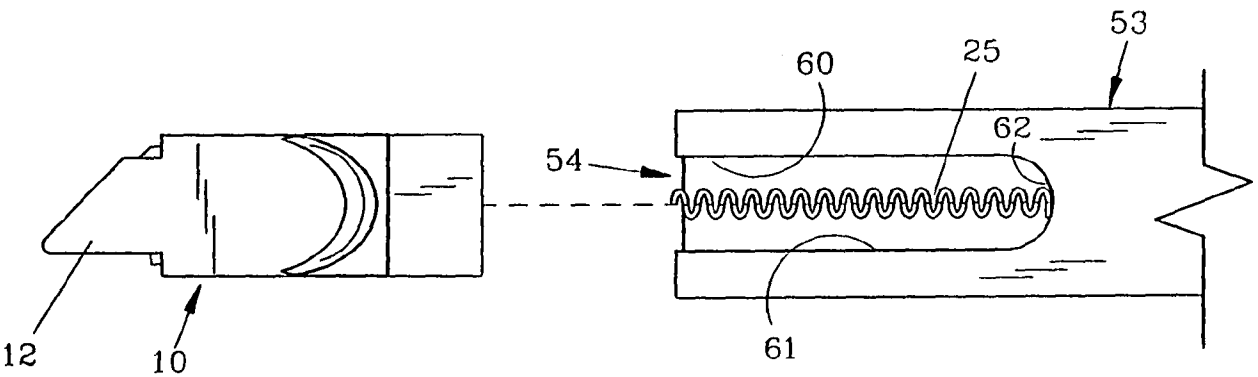
FIG. 5 depicts a partial enlarged top view of the sash as seen in FIG. 3 with the tilt latch exploded therefrom.
Figure 13:
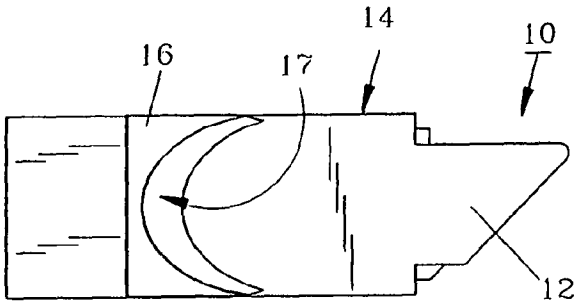
FIG. 13 pictures a top plan view of the tilt latch as shown in FIG. 7.

In FIG. 6 a front view of groove 54 is shown whereby the edges of side frame member 55 engage latch lower cover shoulders 19, 19' (FIG. 12) to stop, engage and maintain latch 10 within groove 54 which as understood, is normally urged outwardly by spring 25 (FIG. 5).

Figure 4:
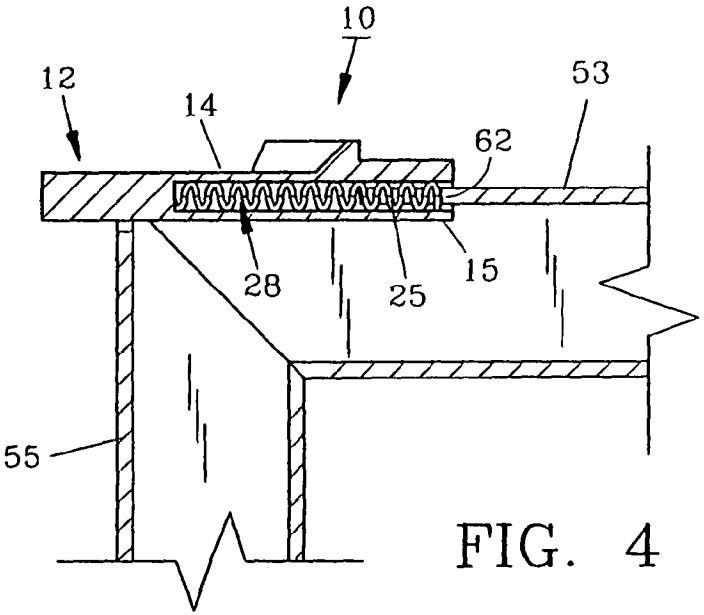
FIG. 4 features a cross-sectional view of a portion of the sash as shown along lines 4-4 as seen in FIG. 3.

Preferred coil spring 25 as shown in FIGS. 4 and 5 is in contact with rear edge 62 of groove 54 formed in upper frame member 53 to normally maintain an outward force on tilt latch 10 and force projection 12 into standard frame recess 57 positioned along the interior of vertical frame member 58 of window 50 as seen in FIG. 1 when sash 52 is closed. Other types of resilient members or springs, such as leaf springs could be used but are not preferred. Frame recesses 57, 57' respectively in vertical frame members 58, 58' as shown in FIG. 1 are conventional as used for standard tilt latches.

FIG. 7 shows a perspective view of preferred tilt latch 10 removed from window 50 with coil spring 25 exploded therefrom. Spring 25 is manually inserted into cavity 28 of body 13 as illustrated in FIG. 4. FIGS. 8-13 show various views of preferred tilt latch 10 as formed from a hard, durable plastic such as glass reinforced nylon but may be made from metals such as zinc, aluminum or alloys thereof. While only tilt latch 10 is described herein in detail, tilt latch 10' which is a mirror image of tilt latch 10 could similarly be described.

Figure 12:
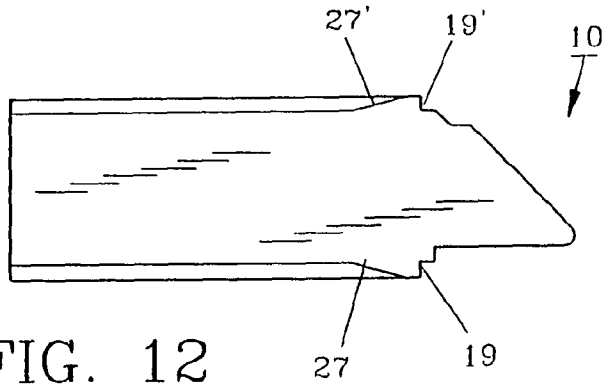
FIG. 12 illustrates a bottom plan view of the tilt latch as shown in FIG. 7.
Figure 11:
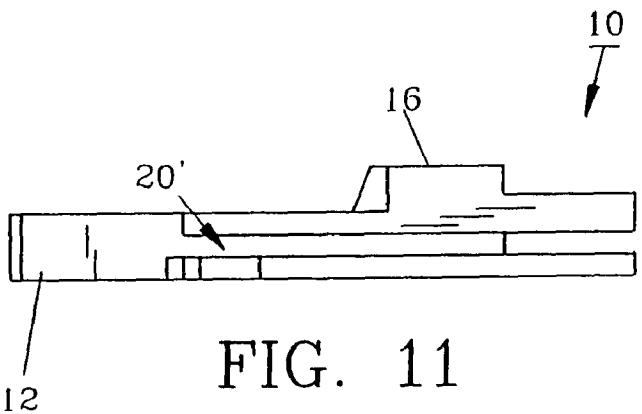
FIG. 11 demonstrates a left side elevational view of the tilt latch with the spring removed.
Figure 8:
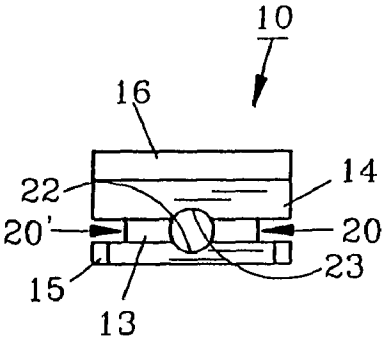
FIG. 8 pictures a rear view of the latch as seen in FIG. 7.
Figure 9:
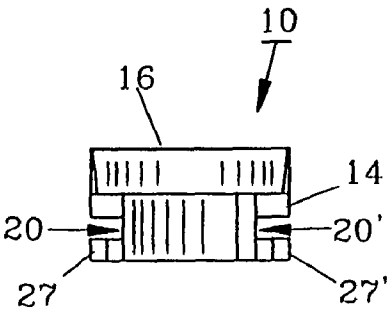
FIG. 9 depicts a front view of the tilt latch as seen in FIG. 7.

In FIG. 10 projection 12 is shown positioned forward of upper cover 14 and lower cover 15. The outer surfaces of covers and 15 are coplanar with the top and bottom surfaces of projection 12 as seen in FIGS. 10 and 11. Shoulders 19, 19' of lower cover 15 as shown in FIG. 12 contact front edges 59, 59' of sash side frame member 55 (seen in FIG. 6) to engage and contain tilt latch 10 within groove 54 when sash 52 is opened as in FIG. 1. Top edges 60, 61 formed in upper frame member 53 and curved rear edge 62 (FIG. 5) surround groove 54 and fit between overhanging upper cover 14 and lower cover 15 as shown in FIGS. 8, 9 and 10 to guide tilt latch 10 in a linear direction along channels 20, 20' (FIGS. 8, 9 and 11) as it moves along groove 54. Upper cover 14 includes top finger tab 16 shown in FIGS. 7, 8, 9, 10, 11 and 13 with arcuate face 17 for easy gripping and manipulation of tilt latch 10.

Coil spring 25 fits within lower cover channel 22 and upper cover channel 23 as shown in FIGS. 7 and 8 to guide spring 25 therealong and to stabilize (prevent bowing) spring 25 once in place as shown in FIG. 10 as spring 25 rests in cavity 28 of body 13.

The preferred method of using tilt latch 10 includes the integral manufacture thereof by conventional molding techniques and once molded, spring 25 is manually inserted along channels 22, 23 into cavity 28 as seen in FIG. 10. Next, tilt latch 10 is inserted into a sash groove such as groove 54 as shown in FIGS. 5 and 6 by manually applying pressure to edges 59, 59' of frame member 55 to slightly spread them apart while compressing spring 25 against rear edge 62 of groove 54 as shown in FIGS. 4, 5 and 6. Ramps 27, 27' (FIGS. 9 and 12) help aid the insertion of latch 10 into groove 54. Lower cover shoulders 19, 19' prevent removal of latch 10 as shoulders 19, 19' engage 59, 59' of side frame member 55 as earlier described. Once tilt latches 10, 10' are so positioned window sash 52 mounted in window frame (FIG. 1) can be pivoted and closed whereby tilt latch 10 engages recess 57 and tilt latch 10' engages recess 57' to securely hold sash 52 in a closed position within window frame 50.

Figure 14:
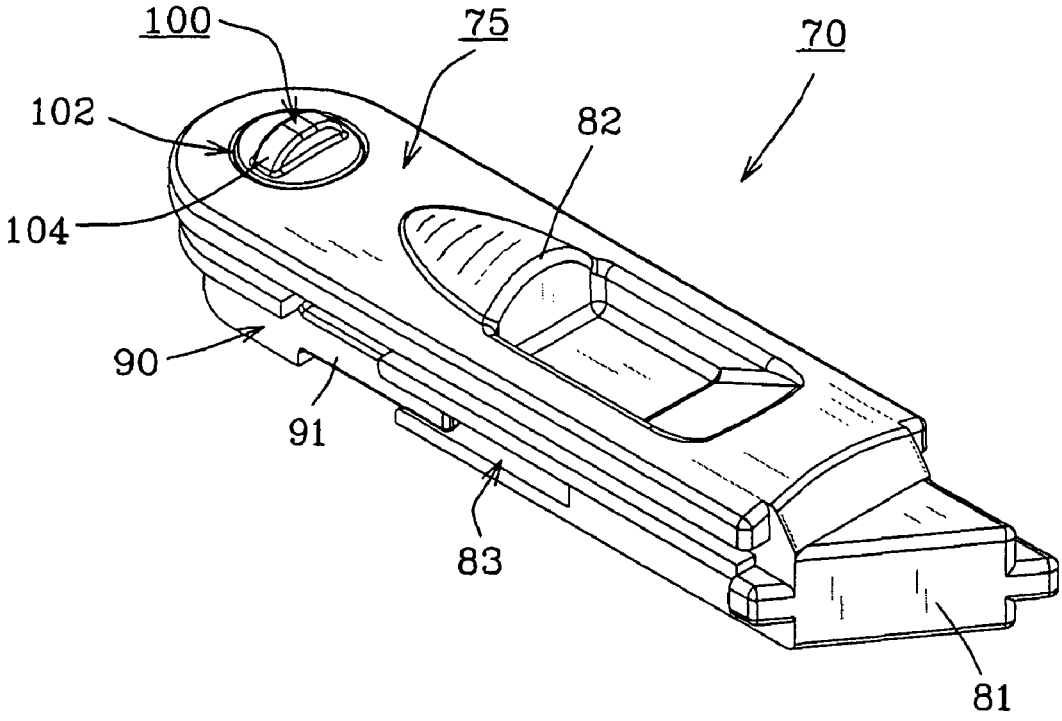
FIG. 14 shows a top, front, left side perspective view of an alternate embodiment of the tilt latch as removed from the window sash.
Figure 17:
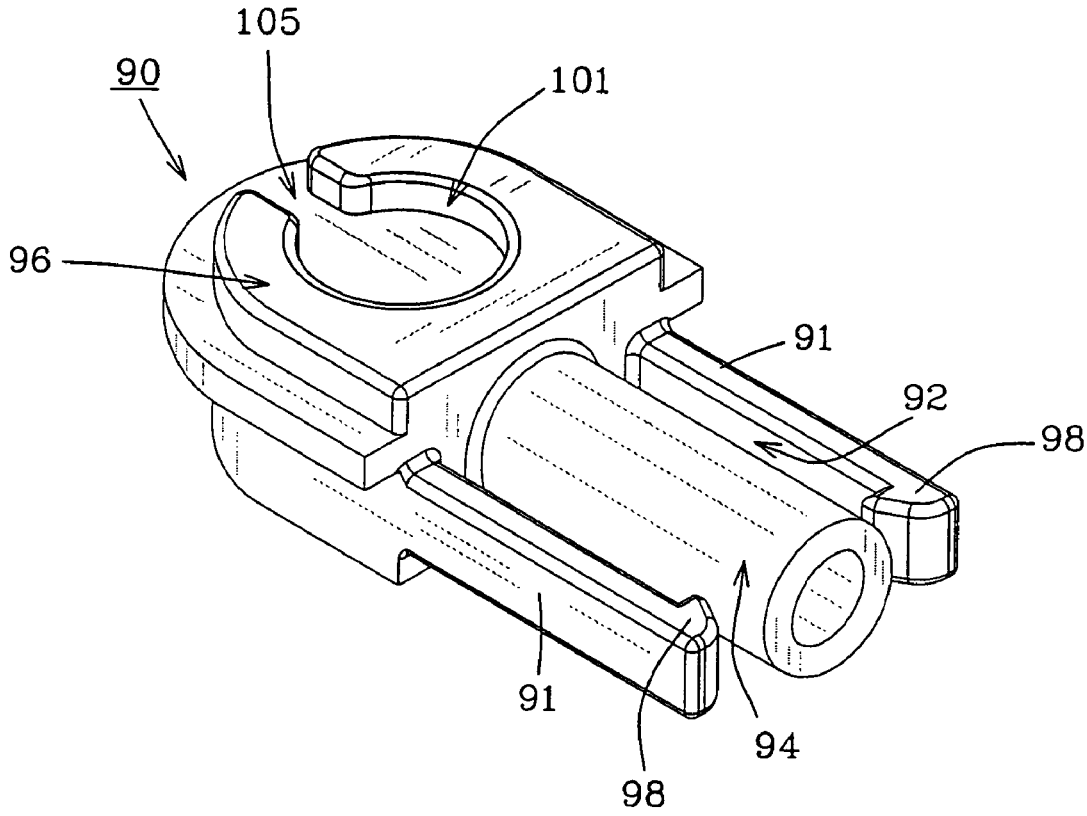
FIG. 17 demonstrates a top, front, left side perspective view of the plunger assembly as removed from the alternate tilt latch.
Figure 19:
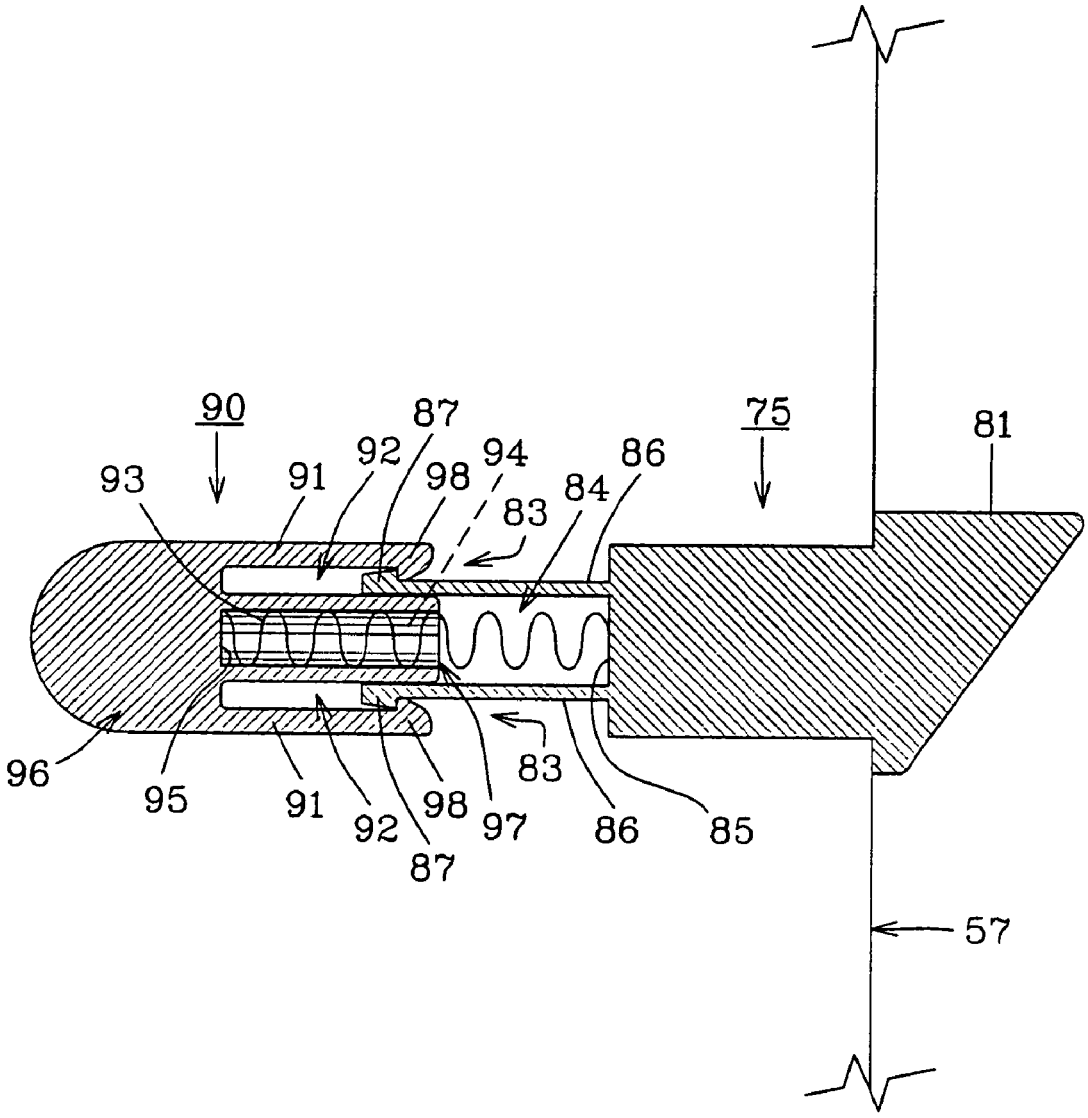
FIG. 19 features an abbreviated cross-sectional view of the alternate tilt latch as shown along lines 19-19 of FIG. 18 but with the tilt latch assembled, the resilient member positioned in an extended state therein and the distal end projection of the tilt latch engaged with the window frame recess.
Figure 20:
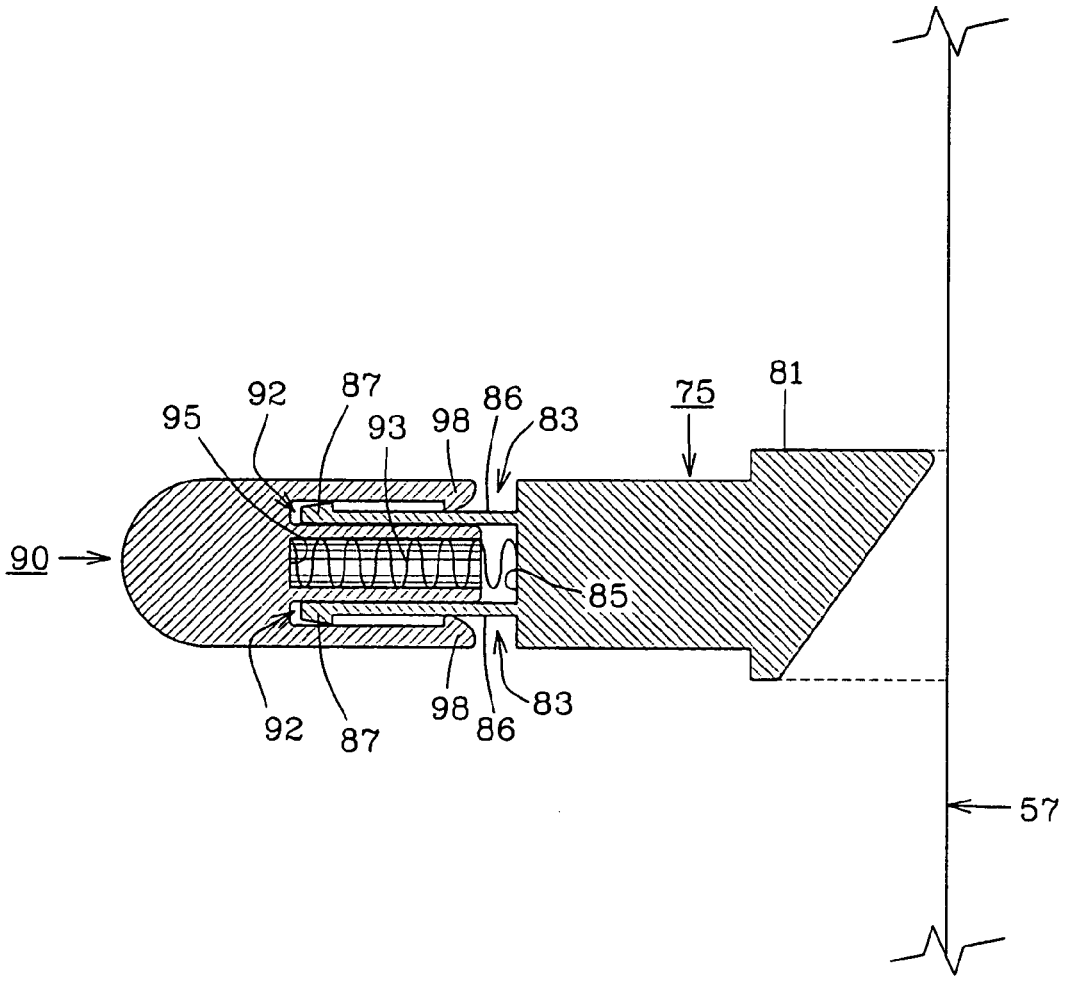
FIG. 20 shows the view of the alternate tilt latch as depicted in FIG. 19 but with the resilient member positioned in a compressed state and the distal end projection of the tilt latch disengaged from the window frame recess.

Alternate tilt latch 70 as shown in FIG. 14 includes body 75, plunger assembly 90 and lock 100. Body 75 and plunger assembly 90 are engaged via guides 86 and protrusions 91 as depicted in FIGS. 19 and 20. Body 75 includes opposing lateral grooves 83 seen in FIGS. 19, 20 which are sized to receive protrusions 91 therein. Body 75 defines guides 86, finger tab 82 and lock opening 102 through which lock 100 projects as seen in FIG. 14. FIG. 17 depicts a perspective view of preferred plunger assembly 90 comprising U-shaped plunger support 96, resilient member housing 94, protrusions 91 with catches 98 and lock depression 101 having distal channel 105 in communication therewith. Plunger support 96 defines lock depression 101 for receiving lock 100 and provides a base from which resilient member housing 94 and protrusions 91 extend. Lock 100 is preferably a "button" lock which is capable of in situ manipulation. However an alternative affixing means, such as a screw, clamp or brad could also be used. Plunger assembly protrusions 91 and resilient member housing 94 define grooves 92 therebetween for receiving guides 86 of body 75 as seen in FIGS. 19 and 20.

Preferably tilt latch 70 is formed of plastic with the exception of resilient member 93 (FIGS. 19 and 20), using conventional molding techniques. However, tilt latch 70 could be formed of metal or other materials for structural strength and high-volume manufacture.

Figure 18:
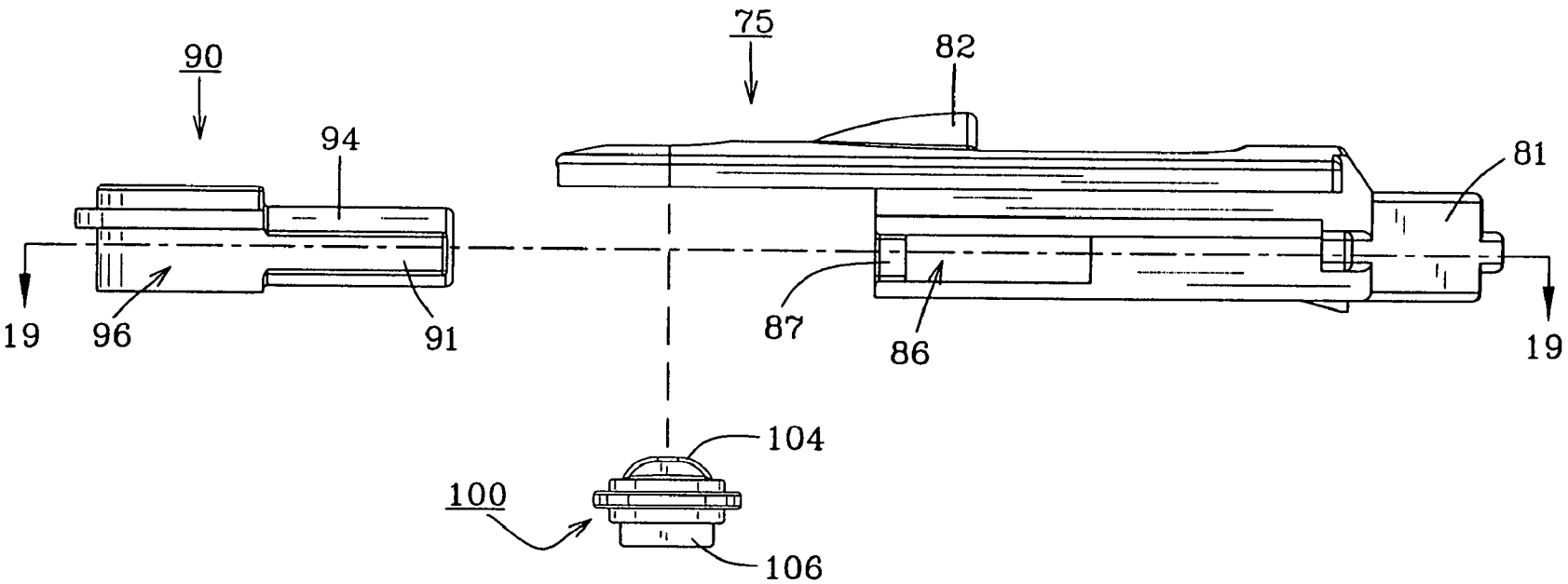
FIG. 18 pictures a left side elevational view of the alternate tilt latch as seen in FIG. 14, but disassembled with the lock and plunger assembly exploded therefrom and without the resilient member.

Assembly of tilt latch 70 as depicted in FIG. 18 includes insertion of lock 100 upwardly into lock opening 102 (FIG. 14) of body 75. Plunger assembly 90 with resilient member 93 therein (not shown) is then aligned and fitted into body 75 by engaging guides 86 with protrusions 91 as depicted in FIGS. 19 and 20. Body 75 is flexed slightly for insertion of plunger assembly 90 during assembly. Resilient member 93 is positioned within resilient member housing 94 as illustrated in FIGS. 19 and 20.

Lock 100 has a diameter greater than lock opening 102 as seen in FIGS. 14 and 18 to prevent lock 100 from upwardly exiting assembled tilt latch 70. To remove lock 100, plunger assembly 90 is withdrawn from body 75 whereby lock 100 can then be replaced as is necessary. Lock 100 as seen in FIG. 18 includes upper tab 104 and lower tab 106 positioned in preferably parallel alignment having a circular middle section therebetween. FIG. 14 depicts lock 100 in situ whereby upper tab 104 is visible and shown perpendicular to channel 105 (FIG. 17) and lower tab 106 (not shown) is contained within lock depression 101. As would be understood, rotating upper tab 104 likewise rotates lower tab 106.

Figure 15:
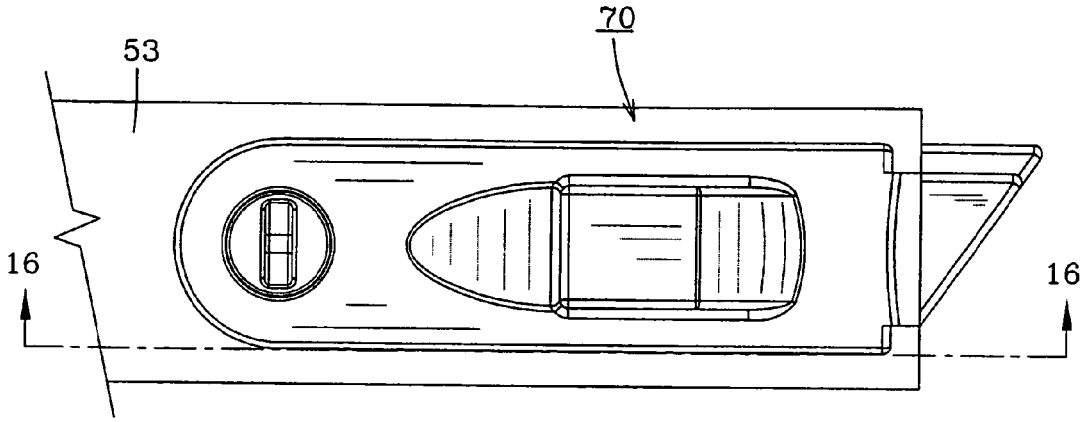
FIG. 15 depicts a top plan view of the alternate tilt latch as seen in FIG. 14 as installed in a window sash.
Figure 16:
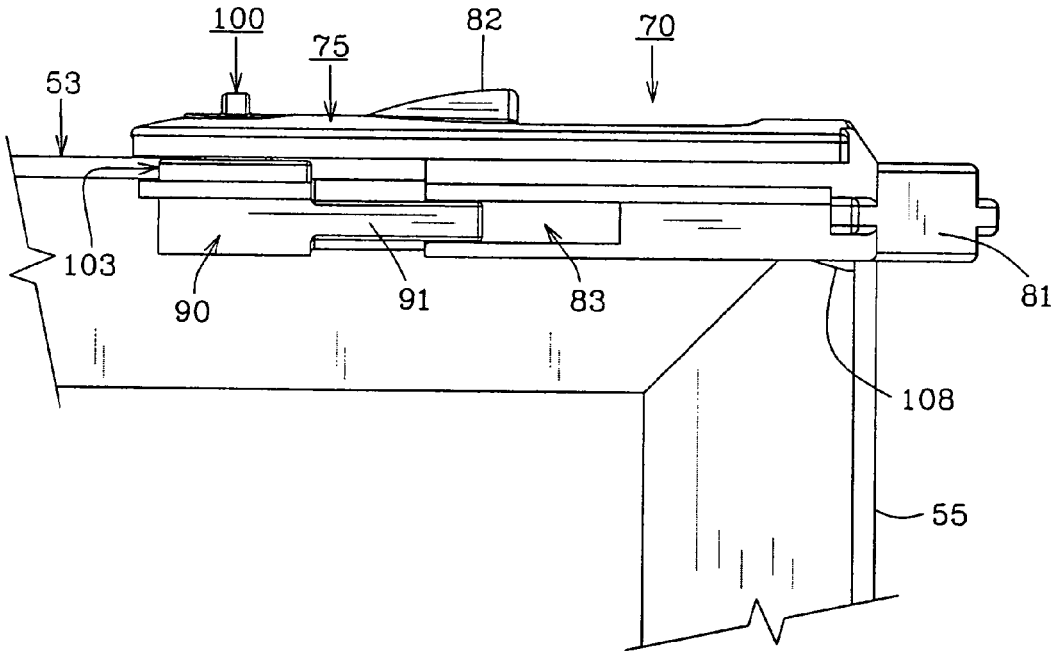
FIG. 16 illustrates a schematic left side elevational view of the alternate tilt latch as shown along lines 16-16 of FIG. 15.

As seen in FIG. 17 lock depression 101 is preferably keyhole shaped and includes distally opening channel 105 which is sized to allow ingress and egress of lower tab 106 positioned parallel to protrusions 91. Lock depression 101 is sized to allow lower tab 106 to rotate therein. To lock tilt latch 70 and prevent movement of body 75, lock 100 is manually rotated as seen in FIGS. 14-16 to orient upper and lower tabs 104 and 106 laterally to body 75 (FIG. 16). Laterally positioned lower tab 106 will not pass through channel 105 thereby locking tilt latch in an extended posture as seen in FIGS. 16 and 19. To operate tilt latch 70, upper tab 104 is rotated to orient lower tab 106 as illustrated in FIG. 18 in longitudinal alignment with body 75 to allow lower tab 106 to pass through channel 105. Next the user pushes finger tab 82 toward lock 100. Finger tab 82 and projection 81 are continuously oriented on body 75 such that urging finger tab 82 results in retracting projection 81 as illustrated in FIG. 20 and compressing resilient member 93 within housing 94. Finger tab 82 (FIG. 16) is preferred but a finger tip aperture or other means to allow the user to manipulate body 75 relative to plunger assembly 90 would also suffice. In the retracted state projection 81 is unavailable to engage in schematic tilt latch frame recess 57 as seen in FIG. 20. Thus, the user may then tilt or otherwise manipulate window sash 52 as desired. As illustrated in FIG. 19, releasing finger tab 82 allows resilient member 93 to return to its extended state, thereby pushing projection 81 outwardly to engage schematic frame recess 57. Lower tab 106 returns to lock depression 101 through channel 105 whereby upper tab 104 can be rotated clockwise or counterclockwise to orient lock 100 as seen in FIG. 15. When projection 81 is engaged in schematic tilt latch frame recess 57, sash 52 is latched in position and may not be tilted. Lock 100 assists to further prevent any movement of projection 81.

When finger tab 82 is slid backward, projection 81 and lower tab 106 are displaced an equal distance. The distance lower tab 106 may travel is limited by the length of channel 105 in lock depression 101, FIG. 17. Thus, the length of channel 105 must be equal or greater than the distance projection 81 must retract and extend to respectively disengage and engage frame recess 57.

Projection 81 is preferably biased to allow it to "click" into schematic tilt latch frame recess 57 (FIG. 19). However, alternative projections are possible so long as they are capable of engaging schematic frame recess 57 and preventing unwanted movement of sash 52 as illustrated in FIGS. 1 and 2.

Mounting channel 103 (FIG. 16) is formed between body 75 and plunger assembly 90 for receiving upper frame member 53 of sash 52 during installation. Alternate tilt latch 70 is mounted in sash groove 54 as previously described for tilt latch 10, depicted in FIGS. 5 and 6. Tilt latch 70 is held in place by mounting channel 103 as seen in FIG. 16. In FIGS. 15 and 16 tilt latch 70 is shown mounted in upper frame member 53. As seen in FIG. 16, tilt latch 70 preferably includes mounting ramp 108 which abuts sash side frame member 55 and helps retain tilt latch 70 in position.

As seen in FIGS. 19 and 20, resilient member 93 is positioned inside resilient member housing 94 with one end terminating at housing abutment 95, and the other end protruding from housing opening 97 into body cavity 84 and terminating at abutment 85 of body 75. When a user slides finger tab 82 as seen in FIG. 18 backwardly toward plunger assembly 90, body 75 likewise moves backwardly as illustrated in FIG. 20. This action compresses resilient member 93 within housing 94 between housing abutment 95 and body abutment 85. Resilient member housing 94 keeps resilient member 93 properly oriented to prevent resilient member 93 from "popping out" of tilt latch 70 or unwanted distortions. Upon release of finger tab 82 the tension applied to resilient member 93 is released and body 75 extends outwardly as demonstrated in FIG. 19. Resilient member 93 is preferably a metallic coil spring. Resilient member 93 could alternatively be a non-metallic spring or non-spring. An example of a non-spring resilient member is a resilient foam which is capable of suitable compression and expansion.

In FIG. 17, plunger assembly 90 is shown having two (2) protrusions 91 each with a catch 98 thereon. Assembly protrusions 91 and resilient member housing 94 define plunger assembly grooves 92 therebetween. As shown in FIGS. 19 and 20, plunger assembly protrusions 91 are slidably engaged with guides 86 having guide catches 87 of body 75. Protrusions 91 are slightly flexible to allows catches 98 to bend outwardly and slide over guide catches 87 during assembly. As seen in FIG. 19, guides 86 are slideable within plunger assembly grooves 92 when finger tab 82 is manipulated. The interaction of protrusions 91 with guides 86 and resilient member 93 therebetween allows body 75 to move relative to plunger assembly 90. When no pressure is applied via finger tab 82 resilient member 93 is expanded. The outward pressure exerted on member abutment 85 and housing abutment 95 causes body 75 and plunger assembly 90 to disengage. However body 75 and plunger assembly 90 are prevented from total disengagement by the interlocking engagement of plunger protrusion catches 98 and guide catches 87. As shown in FIG. 19 plunger protrusion catches 98 "stop" guide projection catches 87 thereby preventing unwanted disengagement. An alternate embodiment could be designed which allows body 75 and plunger assembly 90 to move relative to each other and not disengage.

The illustrations and examples provided herein are for explanatory purposes and are not intended to limit the scope of the appended claims.

The invention claimed is:

1. A tilt latch positionable in a window sash groove having rear and side edges, the window sash retaining a tilting window in relation to a window frame member, said tilt latch comprising: a body, said body comprising a top cover, a finger tab, said finger tab positioned on said top cover, said top cover defining overhanging edges, said overhanging edges positioned along said sash groove side edges when said tilt latch is positioned in the window sash groove, a projection, said projection affixed to said body, said projection for engaging a recess in the window frame member, a plunger assembly, said plunger assembly resiliently joined to said body, said plunger assembly comprising a cylindrical housing, a spring, said spring contained within said plunger assembly cylindrical housing for resilient movement between said body and said plunger assembly, a protrusion, said protrusion attached to said plunger assembly, a catch, said catch attached to said protrusion, a guide, said guide affixed to said body for engaging said protrusion to limit the movement of said body within the window sash.

2. The tilt latch of claim 1 wherein said plunger assembly further comprises a lock opening, said lock opening defined by said plunger assembly, a lock, said lock carried by said plunger assembly in said lock opening.

3. A tilt latch positionable in a window sash groove having rear and side edges, the window sash retaining a tilting window in relation to a window frame member, said tilt latch comprising: a body, said body comprising a top cover, a finger tab, said finger tab positioned on said top cover, said top cover defining overhanging edges, said overhanging edges positioned along said sash groove side edges when said tilt latch is positioned in the window sash groove, a projection, said projection affixed to said body, said projection for engaging a recess in the window frame member, a plunger assembly, said plunger assembly resiliently joined to said body, said plunger assembly comprising a cylindrical housing, a spring, said spring contained within said plunger assembly cylindrical housing for resilient movement between said body and said plunger assembly, a lock opening, said lock opening defined by said plunger assembly, a lock, said lock carried by said plunger assembly in said lock opening, a pair of protrusions, said pair of protrusions attached to said plunger assembly, a catch, said catch attached to one of said pair of protrusions, a pair of guides, said pair of guides affixed to said body for engaging a different one of said pair of protrusions to limit the movement of said body within the window sash.

4. The tilt latch of claim 3 wherein said spring comprises a coil spring.

5. The tilt latch of claim 3 wherein said tilt latch body is formed from a moldable material.

6. The tilt latch of claim 3 wherein said lock further comprises a circular middle section, an upper tab, a lower tab, said upper and lower tabs carried by said circular middle section.

7. The tilt latch of claim 6 wherein said lock further comprises a diameter greater than said lock opening.

8. A tilt latch positionable in a window sash groove having rear and side edges, the window sash retaining a tilting window in relation to a window frame member, said tilt latch comprising: a body, said body defining a cavity, a top cover, said top cover affixed to said body and overhanging said body and said sash groove side edges when said tilt latch is positioned in the window sash groove, a projection, said projection affixed to said body proximate said body cavity, a plunger assembly, said plunger assembly contained within said body cavity, said plunger assembly comprising a cylindrical housing, a spring, said spring contained within said plunger assembly cylindrical housing for resilient movement between said body and said plunger assembly, a lock opening, said lock opening defined by said plunger assembly, a lock, said lock carried by said plunger assembly in said lock opening, said lock comprising a circular middle section, an upper tab, a lower tab, said upper and lower tabs carried by said circular middle section, a protrusion, said protrusion attached to said plunger assembly housing, a catch, said catch attached to said protrusion, a guide, said guide affixed to said body for engaging said protrusion to limit the movement of said body.

9. The tilt latch of claim 8 wherein said spring comprises a coil spring.

10. The tilt latch of claim 8 wherein said tilt latch body is formed from a moldable material.

11. A tilt latch positionable in a window sash groove having rear and side edges, the window sash retaining a tilting window in relation to a window frame member, said tilt latch comprising: a body, said body defining a cavity, a top cover, said top cover affixed to said body and overhanging said body and said sash groove side edges when said tilt latch is positioned in the window sash groove, a projection, said projection affixed to said body proximate said body cavity, a plunger assembly, said plunger assembly contained within said body cavity, said plunger assembly comprising a cylindrical housing, a spring, said spring contained within said plunger assembly cylindrical housing for resilient movement between said body and said plunger assembly, a lock opening, said lock opening defined by said plunger assembly, a lock, said lock carried by said plunger assembly in said lock opening, said lock comprising a circular middle section, an upper tab, a lower tab, said upper and lower tabs carried by said circular middle section, said lock having a diameter greater than said lock opening, a pair of protrusions, said pair of protrusions attached to said plunger assembly housing, a catch, said catch attached to one of said pair of protrusions, a pair of guides, said pair of guides affixed to said body for engaging different ones of said pair of protrusions to limit the movement of said body.

12. The lock of claim 8 wherein said lock further comprises a diameter greater than said lock opening.

* * * * *